US006745159B1

(12) United States Patent
Todd et al.

(10) Patent No.: US 6,745,159 B1
(45) Date of Patent: Jun. 1, 2004

(54) PROCESS OF DESIGNING SCREENLESS COMPLETIONS FOR OIL OR GAS WELLS

(75) Inventors: Bradley L. Todd, Duncan, OK (US); Ronald G. Dusterhoft, Katy, TX (US); Philip D. Nguyen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/560,523

(22) Filed: Apr. 28, 2000

(51) Int. Cl.[7] ..... G06G 7/48; G01W 15/08; G01V 1/40; G01V 3/18; G01V 5/04; G01V 9/00; G06F 19/00; E21B 33/13; E21B 43/26

(52) U.S. Cl. ..... 703/10; 702/13; 166/281

(58) Field of Search ..... 703/10; 166/281; 702/13

(56) References Cited

U.S. PATENT DOCUMENTS 5,546,792 A * 8/1996 Becker ..... 73/64.53
5,839,510 A * 11/1998 Weaver et al. ..... 166/276
6,012,016 A * 1/2000 Bilden et al. ..... 702/12
6,101,447 A * 8/2000 Poe, Jr. ..... 702/13

OTHER PUBLICATIONS

M.J. Economides, L.T. Watters, and S. Dunn–Norman, *Petroleum Well Construction,* pp. 91–118, John Wiley & Sons (1998).

* cited by examiner

*Primary Examiner*—W. Thomson
*Assistant Examiner*—Dwin M. Craig
(74) *Attorney, Agent, or Firm*—Robert A. Kent; C. Clark Dougherty, Jr.

(57) ABSTRACT

A process of designing a screenless completion for an oil or gas well includes selecting an oil or gas well having known characteristics and inputting data about them into a computer; determining, through operation of the computer, whether a screenless completion should be performed on the selected well and, if so, identifying materials to be used in the screenless completion and in response indicating to a user a screenless completion design using the identified materials. Different types of screenless completion designs are made available. These steps can be performed for multiple wells, preferably with similar results for similar wells.

14 Claims, 12 Drawing Sheets

PROCESS OF DESIGNING SCREENLESS COMPLETIONS FOR OIL OR GAS WELLS

BACKGROUND OF THE INVENTION

This invention relates generally to screenless completions for oil or gas wells. More particularly, the invention relates to designing screenless completions for oil or gas wells, which includes determining which wells are suitable for screenless completion and associating a particular predefined screenless completion design with a particular well and with wells of similar characteristic.

One stage in creating an oil or gas well is to complete the drilled borehole in a manner which hopefully enhances the production of oil or gas from the well. There are many different completion techniques; however, in general, completion preferably occurs so that the well will produce desired hydrocarbons and not undesired materials (e.g., formation solids) from one or more hydrocarbon-bearing formations intersected by the well bore. In some wells, mechanical equipment referred to as screens or gravel packs are lowered during completion into the well bore adjacent a formation from which production is to occur. Such equipment allows gas and liquid to flow through the screen or gravel pack structure during production, but it blocks formation solids which have larger diameters than the flow paths through the screen or gravel pack.

In some but not all wells, another way to permit hydrocarbon flow while blocking formation solid flow out of a formation is to use a screenless technique which does not require downhole mechanical equipment such as a screen or gravel pack. In a screenless completion, a mixture of fluid and particulate solids, such as proppant, is pumped into the well. This may be part of a fracturing operation during which the mixture is pumped under pressure to hydraulically fracture a formation. Upon fracture, at least a portion of the mixture is in the formation. Typically, the fluid portion returns to the well and up to the surface for disposal; the proppant, however, preferably stays in place to prop the fracture open.

To prevent flow-back of proppant as well as of loose or incompetent sand in the fractured zone with fluids produced from the zone, at least a portion of the proppant used in a screenless completion is coated with a hardenable resin composition which is caused to harden and consolidate the proppant in the zone. In one typical use, the resin composition coated proppant is deposited in the fracture after a larger quantity of uncoated proppant has been deposited therein. That is, the last portion of the proppant deposited in each fracture, referred to in the art as the "tail-end" portion, is coated with the hardenable resin composition. When the viscous fracturing fluid which is the carrier fluid for the proppant is broken and reverts to a thin fluid in known manner, the resin coated proppant is deposited in the fractures and the fractures close on the proppant. The partially closed fractures apply pressure on the resin coated proppant whereby the proppant particles are forced into contact with each other while the resin composition hardens. The hardening of the resin composition under pressure brings about the consolidation of the resin coated proppant particles into a hard permeable pack having sufficient compressive strength to prevent unconsolidated proppant and formation sand from flowing out of the fractures with produced fluids which are able to flow through the permeable pack.

In fracture treatments carried out in an unconsolidated formation, good consolidation of proppant is required in the perforations which extend from inside the well bore through casing and cement into the unconsolidated formation as well as in the fractured portions of the unconsolidated formation surrounding the well bore. The tail-end portion of the proppant which is deposited in the perforations and in the fractures is coated with a hardenable resin composition and caused to harden. The resulting consolidated proppant in the perforations and fractures contributes to the prevention of proppant flow-back. However, there is often little closure pressure applied to the resin coated proppant in the fractures in an unconsolidated formation, and there is no closure pressure applied to the resin coated proppant in the perforations. As a result, the consolidated permeable packs formed in the perforations and fractures may have less than sufficient compressive strength to prevent unconsolidated proppant and formation sand from flowing out of the perforations and fractures.

The above problem is complicated when the viscous carrier fluid (the fracturing fluid in the above examples) is a cross-linked gelled fluid containing a breaker which does not break for a relatively long period of time, during which the resin composition coated on the proppant hardens. At high temperatures and particularly temperatures above about 200° F., such resin composition hardens quickly and if the viscous carrier fluid has not broken, the resin coated proppant particles are separated from each other by films of the viscous carrier fluid. As a result of the presence of the carrier fluid films, the proppant does not sufficiently consolidate and proppant flow-back occurs. Thus, when resin coated particulate solids are consolidated in subterranean zones where there is little or no closure pressure exerted on the resin coated particulate solids or when a carrier fluid used to carry resin coated particulate solids into a subterranean zone does not break before the resin hardens, or both, sufficient consolidation of the particulate solids may not take place. However, a recent invention addresses this by providing improved hardenable resin compositions which are basically comprised of a hardenable organic resin, an aminosilane resin-to-particulate solid coupling agent, a viscous carrier fluid temperature activated breaker for converting separating films of viscous carrier fluid between adjacent resin coated particulate solids to thin fluids whereby the resin coated particulate solids contact each other, and a surface active agent for causing the resin to flow to the contact points between adjacent resin coated particulate solids.

The hard permeable packs referred to above are typically made in one of two ways. One way is to mix a pre-coated particulate solid (e.g., proppant) with the viscous carrier fluid (e.g., fracturing fluid), which mixture is pumped into the well in known manner. The other technique is to form a mixture of viscous carrier fluid with liquid resin and particulate solids which become coated with the liquid resin during the action of pumping the mixture into the well. This latter technique is used for the aforementioned improved hardenable resin compositions having particular application where there is little or no formation pressure to assist the consolidation.

Until now, which type of materials (e.g., the pre-coated proppant/fracturing fluid or liquid resin/proppant/fracturing fluid materials) to use in screenless completions, and on which wells, has been somewhat of an art based on a particular job designer's knowledge and experience. This has, unfortunately, led to job failures. Thus, there is the need for an automated, repeatably consistent process by which any oil or gas well can be evaluated as to whether it is a candidate for a screenless completion, and if it is, by which a particular screenless completion design for that candidate well can be determined.

SUMMARY OF THE INVENTION

The present invention meets the aforementioned needs by providing a novel and improved process of designing a screenless completion for one or more oil or gas wells. The present invention enables screenless completions to be more efficiently designed for oil or gas wells, and it should enable screenless completions to be used in at least some applications where prior types of screenless completion jobs in similar wells have experienced failure. The present invention also has as an object that new opportunities for screenless completions not be overlooked.

The automated process of the present invention can save on time and costs relative to prior design techniques of manually determining the feasibility of a screenless design for a specific well. The present invention provides for more consistent analysis and more consistent job design from well to well. The present invention can be used to assist completion engineers and operators in selecting a feasible and economical design for a given well.

The present invention provides a process of designing a screenless completion for an oil or gas well. One definition of this process comprises: selecting an oil or gas well having a plurality of known characteristics; inputting data about the known characteristics into a programmed computer; determining, through operation of the programmed computer, whether a screenless completion should be performed on the selected well and, if so, identifying materials to be used in the screenless completion; and in response to identifying materials to be used, indicating to a user a screenless completion design using the identified materials.

The present invention can further comprise performing the selecting, inputting, determining, identifying, and indicating steps for other oil or gas wells, wherein identifying materials includes identifying the same materials for the respective screenless completion for each well having the same value set of known characteristics for which data are input into the computer.

Identifying materials can include distinguishing, through operation of the computer, between wells for which a liquid resin, proppant and fracturing fluid are to be used and wells for which a proppant, pre-coated with resin, and fracturing fluid are to be used. For wells for which a liquid resin, proppant and fracturing fluid are to be used, preferably a liquid resin which does not substantially adversely affect the fracturing fluid and yet which coats the proppant in the fracturing fluid and enables a high compressive strength proppant pack to be obtained when placed in the well is identified.

To distinguish which wells need which materials, one or more comparisons are made in the computer with regard to input data representing one or more of a relevant temperature in the well (typically referred to as a bottom-hole temperature), angular deviation, interval length, horizontal stress contrast, fracture gradient, ability to orient perforations, formation rock properties, and whether there is or was geopressuring.

Another definition of the overall process of the present invention is as a process of designing a screenless completion for an oil or gas well, comprising: selecting an oil or gas well having a plurality of known characteristics; inputting data about the known characteristics into a computer; determining, through operation of the computer, one of three options for the selected well including (1) determining-that the selected well is not a candidate for screenless completion, (2) determining that the selected well is a candidate for screenless completion using a mixture of a carrier fluid, a hardenable resin composition, and particulate solids, and (3) determining that the selected well is a candidate for screenless completion using a mixture of a carrier fluid and particulate solids pre-coated with a hardenable resin composition before mixing with the carrier fluid; and in response to (2) or (3) above, indicating to a user one of a plurality of screenless completion designs using the respective one of the carrier fluid, hardenable resin composition and particulate solids or the carrier fluid and per-coated particulate solids.

Still another definition of the present invention is as a process of designing a screenless completion for an oil or gas well, comprising: selecting an oil or gas well having a plurality of selected known characteristics including whether there is to be new completion in the selected well or recompletion of an old zone having existing perforations, a deviation at a perforation interval, a length of the perforation interval, a fracture gradient, a degree of horizontal stress contrast, formation rock properties, whether the perforation zone is or was geopressured, and a temperature in the well; inputting data about the known characteristics into a computer; determining, through automatic operation of the computer responsive to the input data, whether a screenless completion should be performed on the selected well and, if so, identifying materials to be used in the screenless completion; and indicating to a user, through automatic operation of the computer, one of at least nine predetermined screenless completion designs, wherein the indicated one includes the identified materials and is selected by the computer in response to the input data.

A further definition of the present invention is as a process of designing a screenless completion for an oil or gas well, comprising: inputting into a computer data characterizing a perforation interval for an oil or gas well; comparing in a selected predetermined sequence in the computer input data with predetermined data correlated by characteristic of the perforation interval, including selecting the predetermined sequence in response to each compared characteristic; associating in the computer one of a plurality of predetermined screenless completion design files, stored in the computer, with the selected predetermined sequence; and displaying the associated predetermined screenless completion design file to a user such that the displayed file is used for performing the predetermined screenless completion on the oil or gas well.

Therefore, from the foregoing, it is a general object of the present invention to provide a novel and improved process of designing a screenless completion for one or more oil or gas wells. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
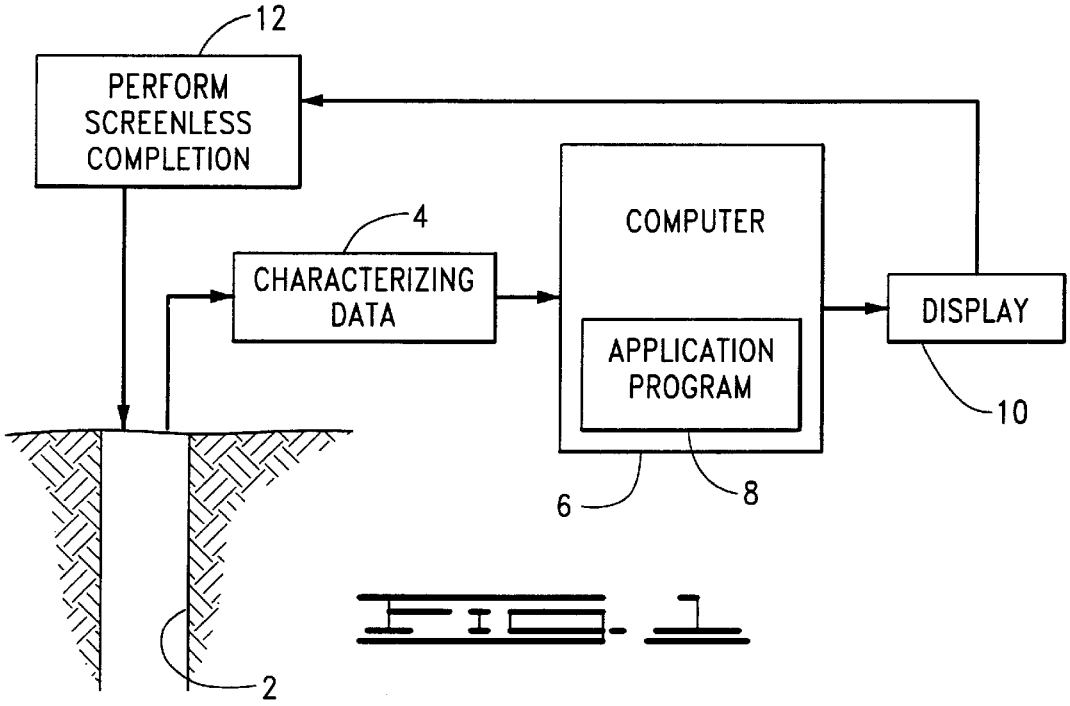
FIG. 1 is a block diagram illustrating the process of the present invention in association with an oil or gas well found to be a candidate for screenless completion.

Referring to FIG. 1, a well borehole 2 has been drilled and is ready for completion. At this stage of the development of the well, characterizing data 4 have been obtained in known manners. The data 4 are input into a computer 6 having an application program 8 in accordance with the present invention. Output from the computer 6 is perceptively provided via a display 10. Information obtained from the display 10 is used in performing a specified screenless completion 12 if it has been determined by the present invention that the well 2 is a candidate for screenless completion.

The well 2 is of any type used in the production of oil or gas (including ones that produce m both oil and gas). These are referred to as oil or gas wells, which includes ones from which oil or gas is produced directly as well as ones which are used in the production of oil or gas from other wells (e.g., injection wells through which fluids are injected into a formation to drive hydrocarbons from the formation into other wells intersecting the formation). Such oil or gas wells can be of any type used in the industry (e.g., vertical or directional, including horizontal, wells). For use in the method of designing a screenless completion for an oil or gas well in accordance with the present invention, a particular oil or gas well having a plurality of known characteristics is selected. The known characteristics include the characterizing data 4.

The characterizing data 4 collected from the well 2 characterizes at least a completion interval of interest, such as an interval to be perforated. Characterizing data 4 includes any data related to whether a screenless completion should be attempted or, in other words, whether the well is a candidate for screenless completion. Such data is also of the type related to determining materials or other aspects are to be used in a particular screenless completion for a particular well found to be a candidate. This data includes, but is not necessarily limited to, one or more of the following: whether there is to be new completion in the selected well or recompletion of an old zone having existing perforations, angular deviation of the interval of interest in the respective well (angle the actual well bore interval is deviated from true vertical), a length of the interval (thickness of the interest zone), a degree of horizontal stress contrast at the interval (the level of difference between maximum and minimum horizontal stresses), fracture gradient at the interval (pressure applied to formation which starts to frac or foam fracture; fracture gradient= fracture pressure/true vertical depth of interval), the ability to orient perforations at the interval (whether a perforation gun can be oriented so that the explosive charges to form perforations are lined up in the desirable direction), formation rock properties for the interval (porosity, Poisson's ratio, Young's Modulus, permeability, lithology, mineralogy), whether the interval is or was geopressured (zone with abnormally high pressure, such as, for example, two or three times normal pressure), and temperature (a temperature relevant to the interval to be treated, typically referred to as a bottom-hole temperature). This information is obtained using data collecting equipment and methods known in the art (e.g., such as used in measurement-while-drilling, logging-while-drilling, and geosteering systems and described in *Petroleum Well Construction* by M. J. Economides, L. T. Watters, and S. Dunn-Norman, pages 91–118, John Wiley & Sons, incorporated herein by reference).

The computer 6 into which the selected characterizing data 4 are input is of any suitable type known in the art. A typical embodiment is a personal computer having an operating system with which the application program 8 works. A specific example for implementing the computer 6 is one having at least a 486 processor or equivalent programmed with a Windows 95 operating system and an application program of the present invention using Visual Basic programming language. The computer need not be of a personal computer type; however, within the personal computer type, it can be a desktop, laptop, notebook, palmtop or other sized equipment capable of running the application program 8. The computer 6 can be used at the well site or remote therefrom. Inputting the data into the computer 6 can be by any suitable means, including local manual entry (e.g., via a keyboard or other alphanumeric entry device, or a portable memory device having the data and manually loaded into an externally accessible memory device drive component of the computer 6). Data input can also be by remote access via wireline or wireless communications, including public or private telecommunication systems. Remote data input can be via a direct link (e.g., direct dial connection) or indirect (e.g., the Internet).

The application program 8 used in the computer 6 is compatible with the operating system of the computer 6 (e.g., Visual Basic application program compatible with Windows 95 operating system). The application program 8 is typically loaded on the computer; however, it can be remotely located and accessed via any suitable link, including the aforementioned direct and indirect links, for example. The application program 8 is used in determining, through operation of the computer 6, whether a screenless completion should be performed on the selected well and, if so, identifying materials to be used in this screenless completion. The computer operates automatically in response to the input data; that is, as each item of characterizing data 4 is input, or after some or all of the characterizing data 4 are input, the application program 8 causes the computer 6 to respond automatically in making the decisions and providing the output which are described in more detail below with regard to a particular implementation shown in FIGS. 2A–2N.

The output that is provided by the computer 6 under operation of the application program 8 is transmitted by suitable means to the display 10 (e.g., by known display drivers and electrical signal connectors). The display 10 is any suitable type of device or system which conveys information to a user. Typically this includes a monitor or other display screen, a printer, or other means for communicating the screenless completion design to the user. It is through the display 10 that the present invention indicates to a user a screenless completion design using the materials identified previously in the process of the present invention. In the preferred embodiment further described below, such indicating conveys to the user one of a plurality of screenless completion designs using either a mixture of a carrier fluid, hardenable resin composition and particulate solids or a mixture of a carrier fluid and pre-coated particulate solids. In the preferred embodiment, the indicated screenless completion design is one of a definite number of predetermined possible designs stored in the application program 8 within the computer 6. The particular implementation described below includes nine such predetermined screenless completion designs. Each of these is maintained in a respective text file that is used in creating the output indicated to the user through the display 10.

Once the particular screenless completion design is obtained from the display 10, the indicated screenless completion is performed at the well in known manner. Although there are variations, such as the aforementioned nine predetermined designs, some of these designs have at least one common feature and others have at least one common other feature. The common feature in one of the groups is that it uses a mixture of a pre-coated particulate solid, such as sand used as a proppant, and a viscous carrier fluid (e.g., a fracturing fluid); this system has the proppant coated with the resin before being mixed with the carrier fluid and is referred to herein as a resin coated proppant or "RCP" system. The at least one common feature of the other group is that it uses a mixture comprising a liquid resin, a particulate solid, and a viscous carrier fluid; this is an "on-the-fly" mixture in which the liquid resin coats the particulate solid during the pumping of the initially separate materials into the well. Techniques for mixing and pumping these two types of pumpable fluid mixtures are known in the art with regard to performing screenless completions; however, preferred types of techniques and materials are those provided by Halliburton Energy Services.

With regard particularly to a mixture comprising liquid resin, particulate solids, and viscous carrier fluid, constituents should be selected to provide compatibility. Compatibility is defined here as the ability to gain high consolidation strengths of the particulate solid, which becomes coated with the liquid resin, under conditions of no closure and yet for the fluid system to maintain acceptable viscosity for the required pump time. The liquid resins and particulate solids should have a minimum affect on the gel viscosity or crosslinking during the required pumping time such that the job can be placed as designed, and yet the resin coated proppant should consolidate with high strength (preferably, greater than 1500 pounds per square inch) in BUS the placement fluid with no closure applied. This can be achieved using an on-the-fly resin coated system (e.g., PropLok™brand, selected for the respective temperature environment of the particular well, from Halliburton Energy Services with hydroxyethylcellulose gel or guar gum based gel crosslinked with borate or zirconium crosslinkers). Another implementation for this type of mixture is-described in U.S. patent application Ser. No. 09/493,998 (HES990006U1) which describes a composition comprising a hardenable organic resin, an aminosilane resin-to-particulate solid coupling agent, a viscous carrier fluid temperature activated breaker for converting separating films of viscous carrier fluid between adjacent resin coated particulate solids to thin films whereby the resin coated particulate solids contact each other, and a surface active agent for causing the resin to flow to the contact points between adjacent resin coated particulate solids.

Although one well is shown in FIG. 1, the present invention can be used with one or more wells. The present invention is particularly suitable for this in that once the characterizing data are entered, the invention automatically determines whether each particular well is a candidate for screenless completion and then defines a particular screenless completion design for each candidate well. The resulting designs are the same for each of the wells having the same value set of known characteristics for which data are input into the computer. That is, if two wells have the same characterizing data, the process of the present invention categorizes them the same (i.e., either each is not a candidate for screenless completion or both are candidates for screenless completion) and the same screenless completion design is applied to each well if they are both candidates. The same occurs if the characterizing data of the two wells are similar, wherein "similar" means the various selected characteristic data are within ranges predefined within the application program 8. Thus, two wells have the same value set of known characteristics if the respective characteristics for the two wells have values within the same respective ranges preset in the application program 8. In the implementation described further below, a particular predetermined screenless completion design file is associated with the same sequence each time that sequence is followed through the process of the present invention; therefore, for each well that the process follows the same sequence, the same design file is displayed.

A particular implementation of the application program 8 used in the computer 6 for performing at least part of the process of the present invention will be described with regard to FIGS. 2A–2N. This part of the process determines, through operation of the computer 6, one of three options for the selected well. These three options include (1) determining that the selected well is not a candidate for screenless completion, (2) determining that the selected well is a candidate for screenless completion using a mixture of a carrier fluid, a hardenable resin composition, and particulate solids, and (3) determining that the selected well is a candidate for screenless completion using a mixture of a carrier fluid and particulate solids pre-coated with a hardenable resin composition before mixing with the carrier fluid. Such determination is made with a plurality of the characterizing data being used in the particular implementation. The result of the responsiveness to the selected characterizing data is an associating in the computer of one of a plurality of predetermined screenless completion design files, stored in the computer, with the sequence followed for that particular well.

Figure 2A:
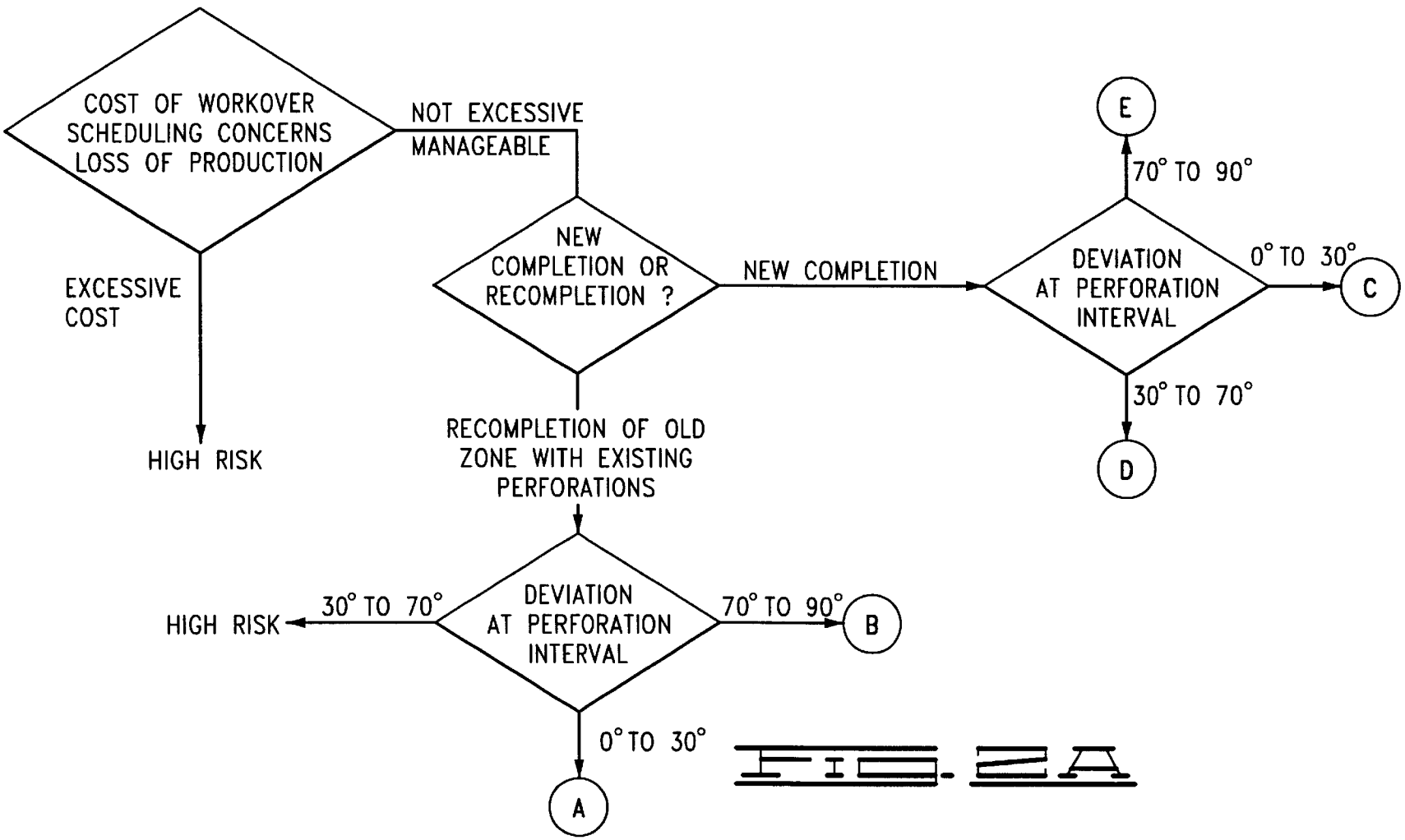
FIGS. 2A–2N form a flow diagram for an application program of a particular embodiment of an automated, computer-implemented portion of the process of the present invention.
Figure 2B:
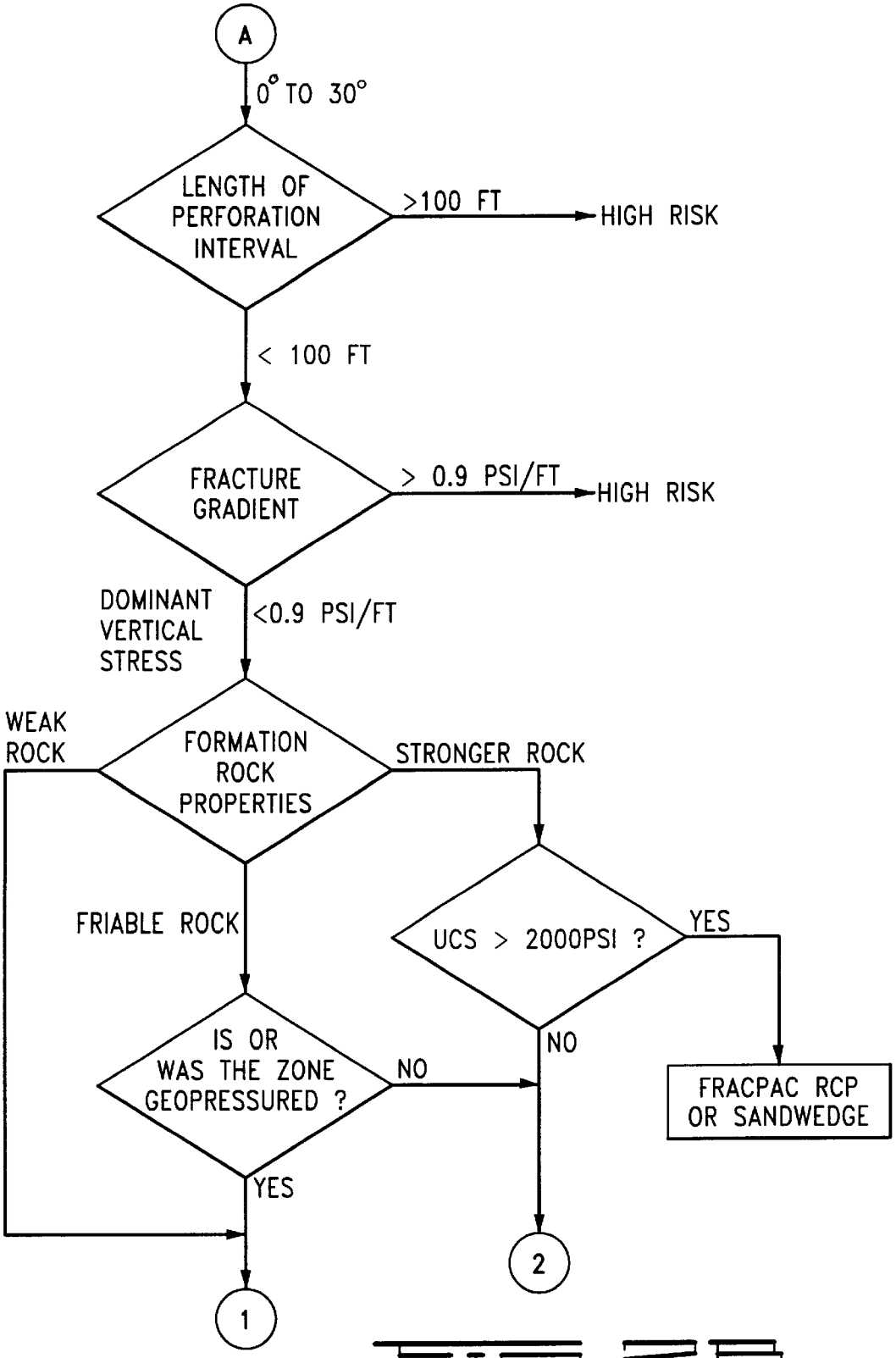
Figure 2C:
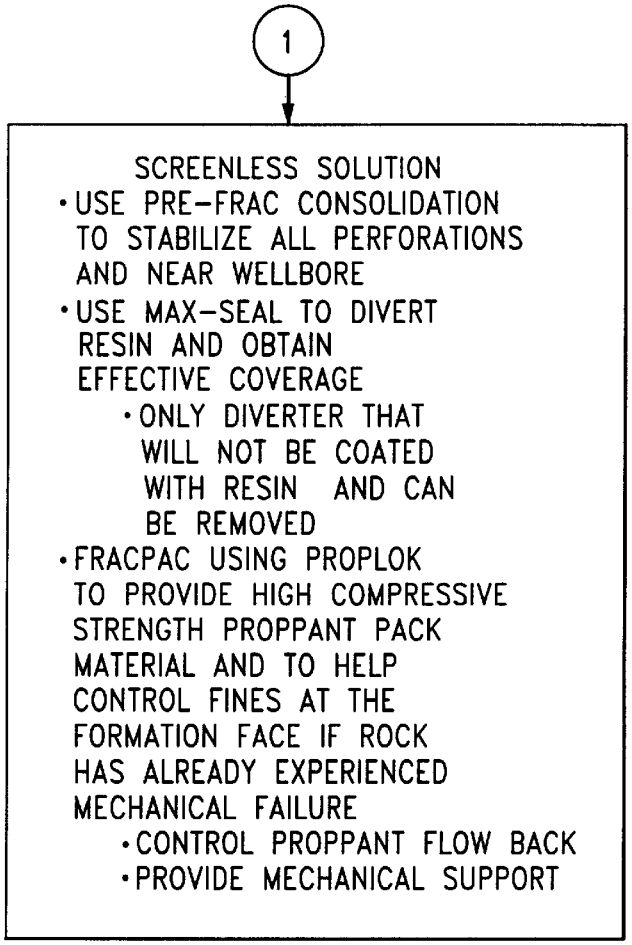
Figure 2D:
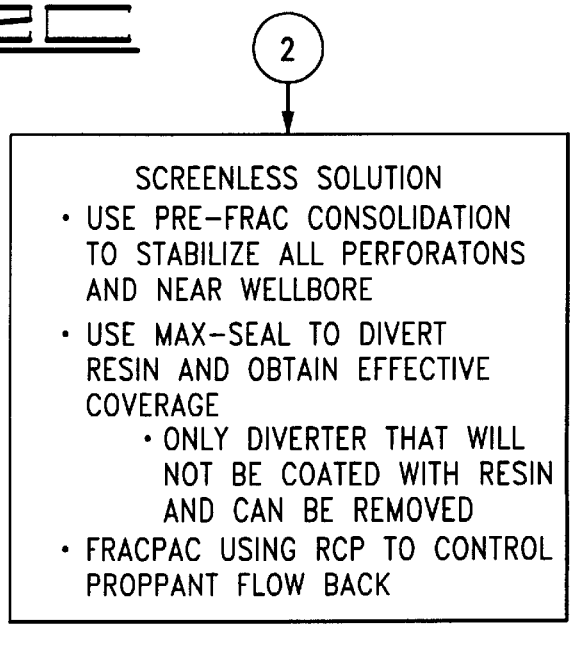
Figure 2E:
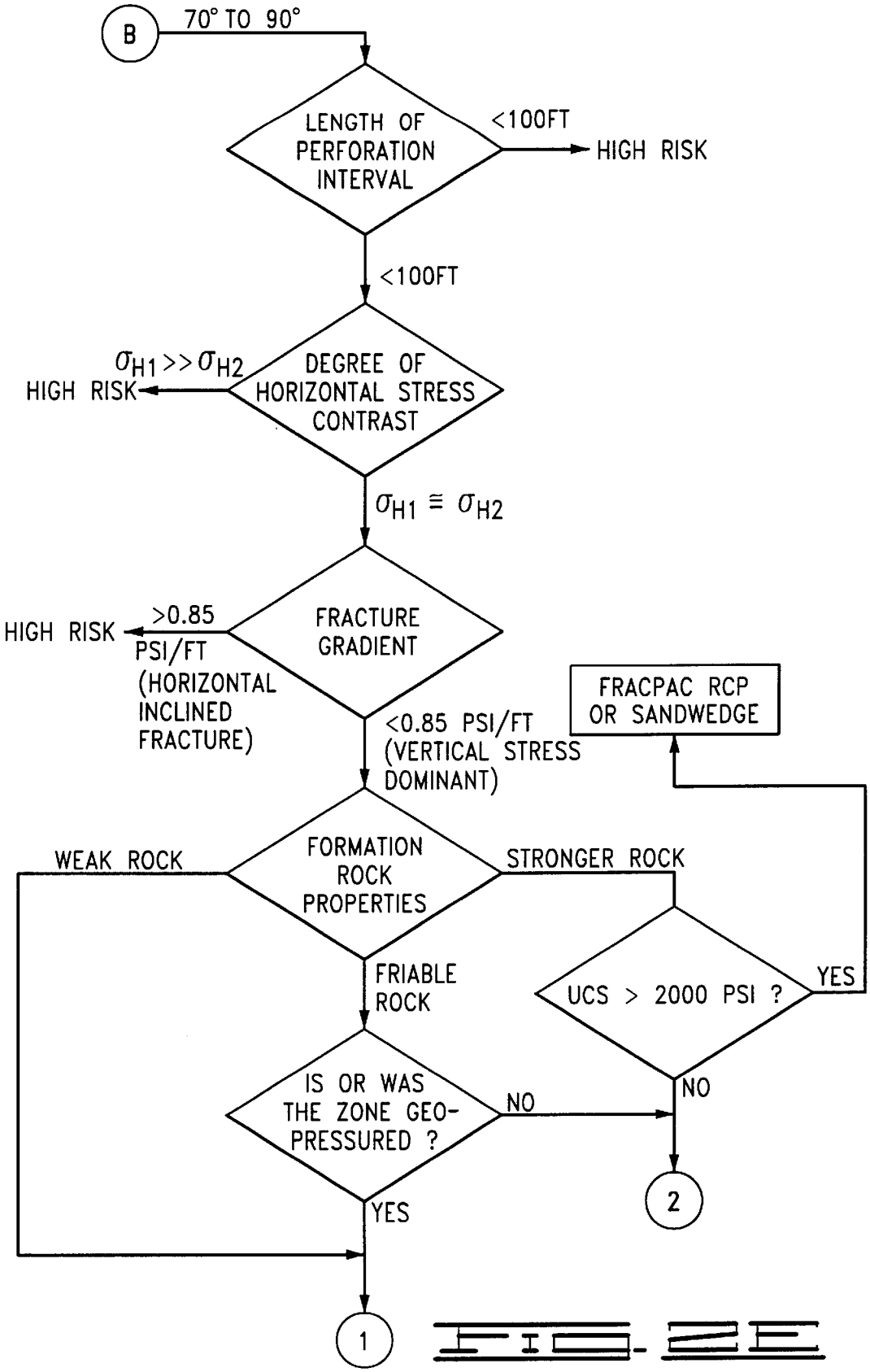
Figure 2F:
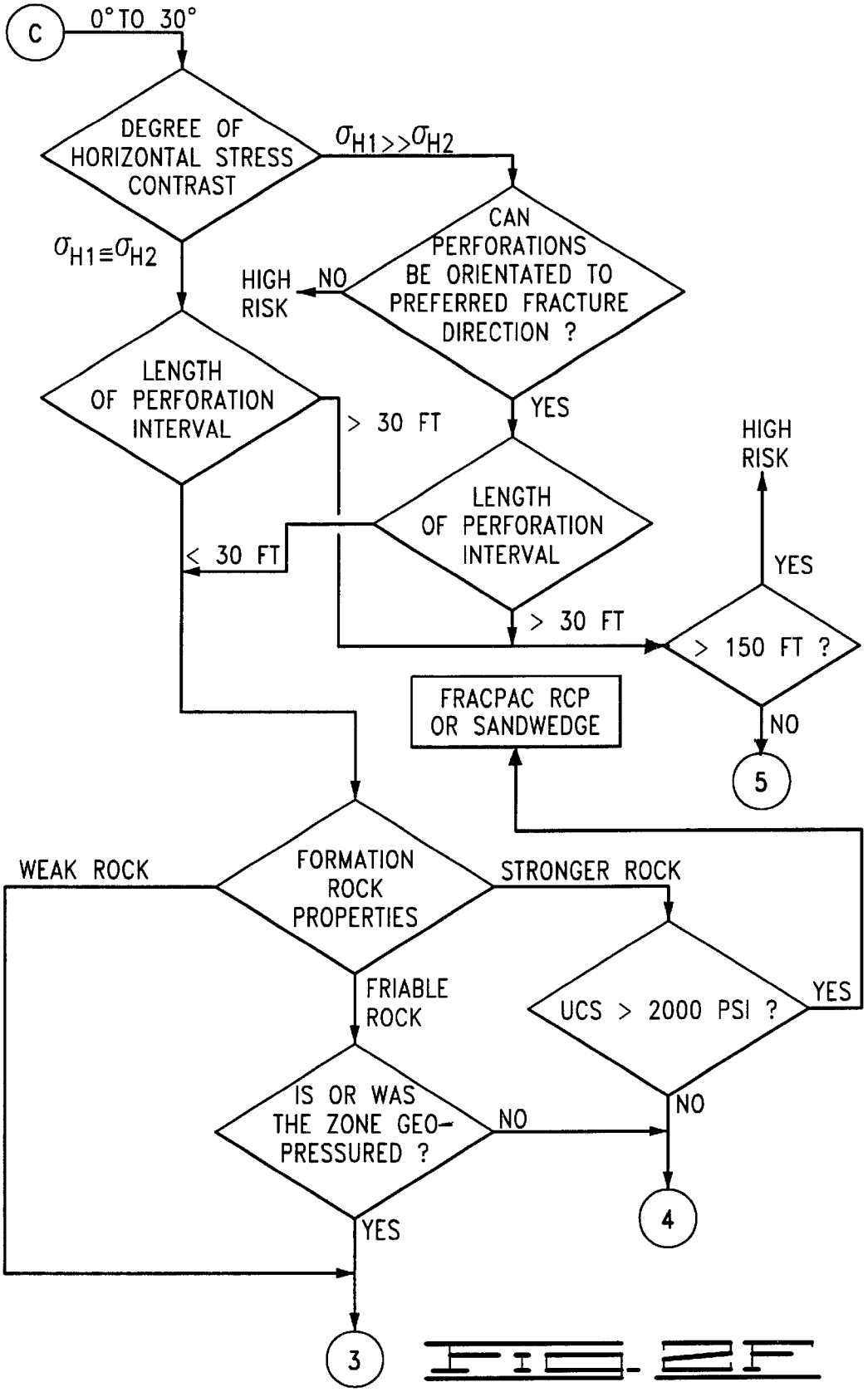
Figure 2G:
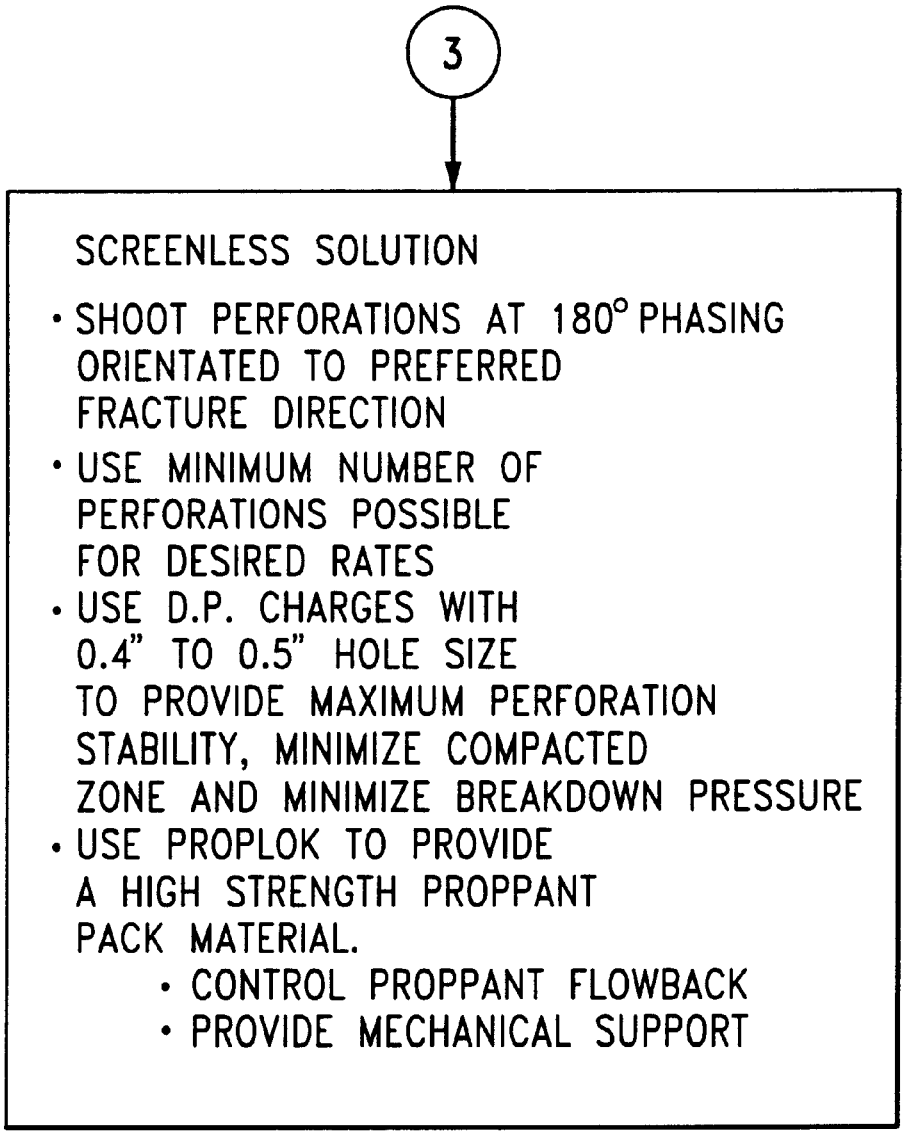
Figure 2H:
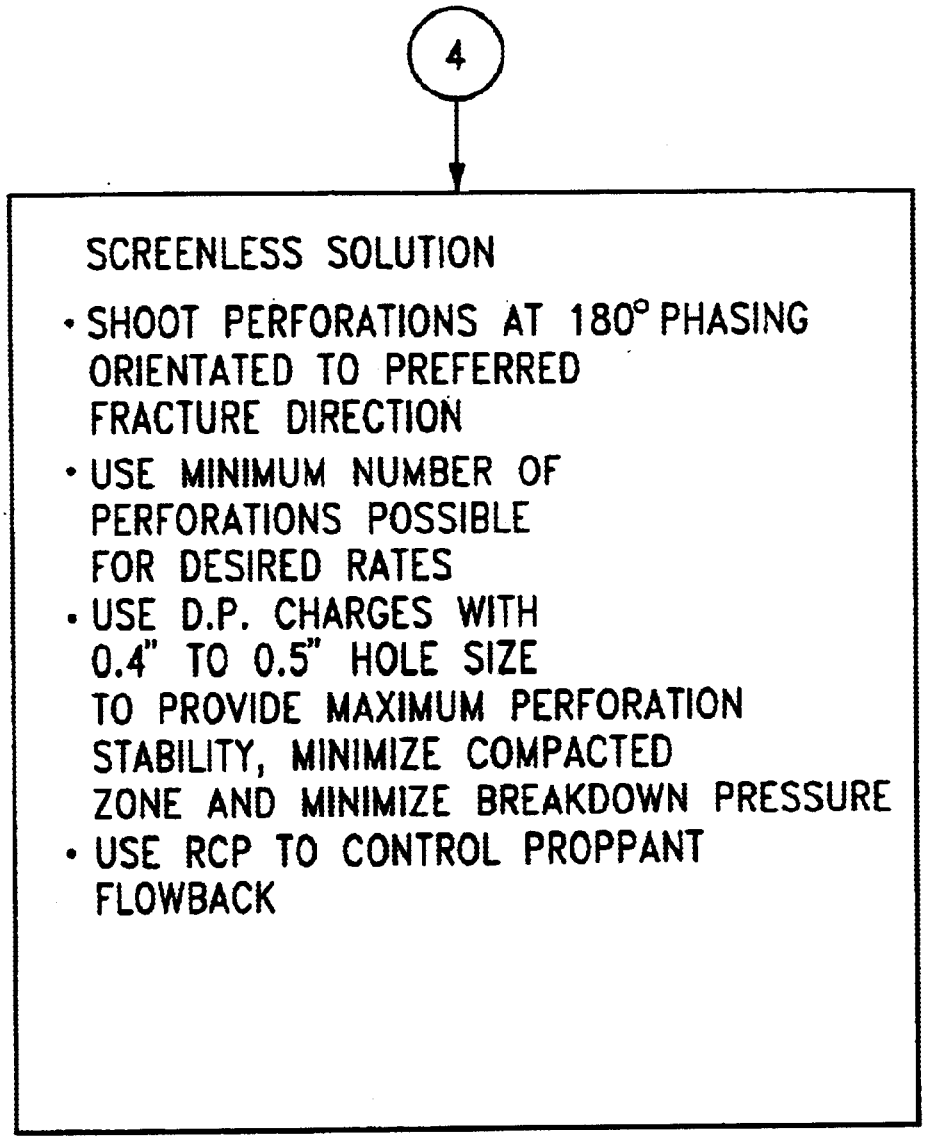
Figure 21:
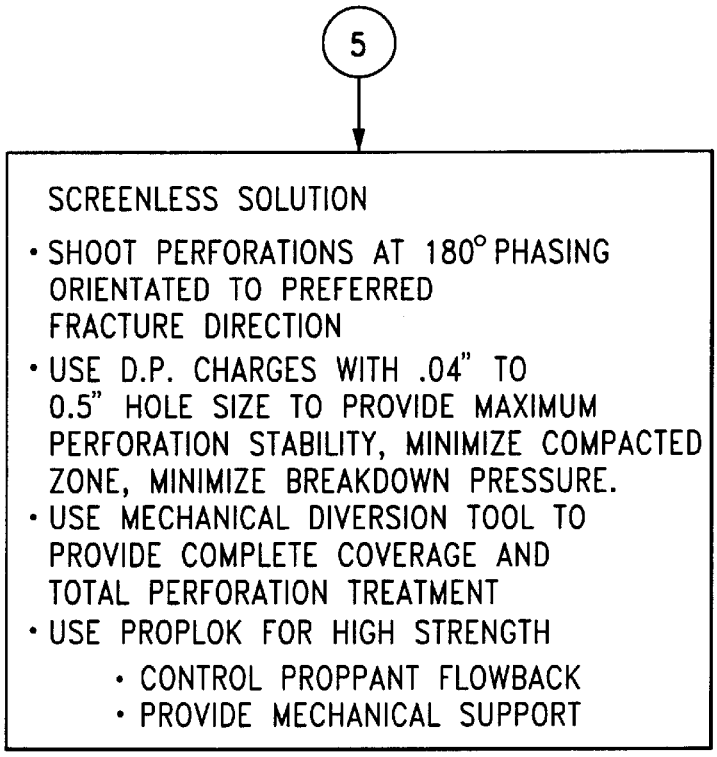
Figure 21:
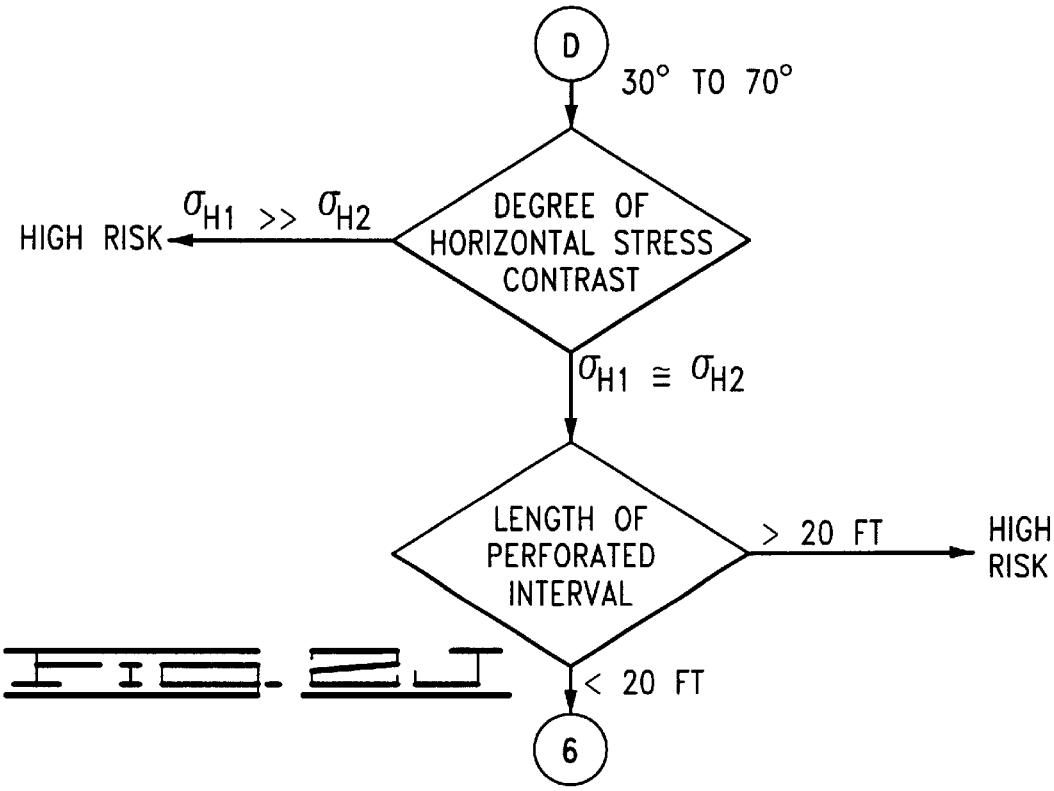
Figure 2K:
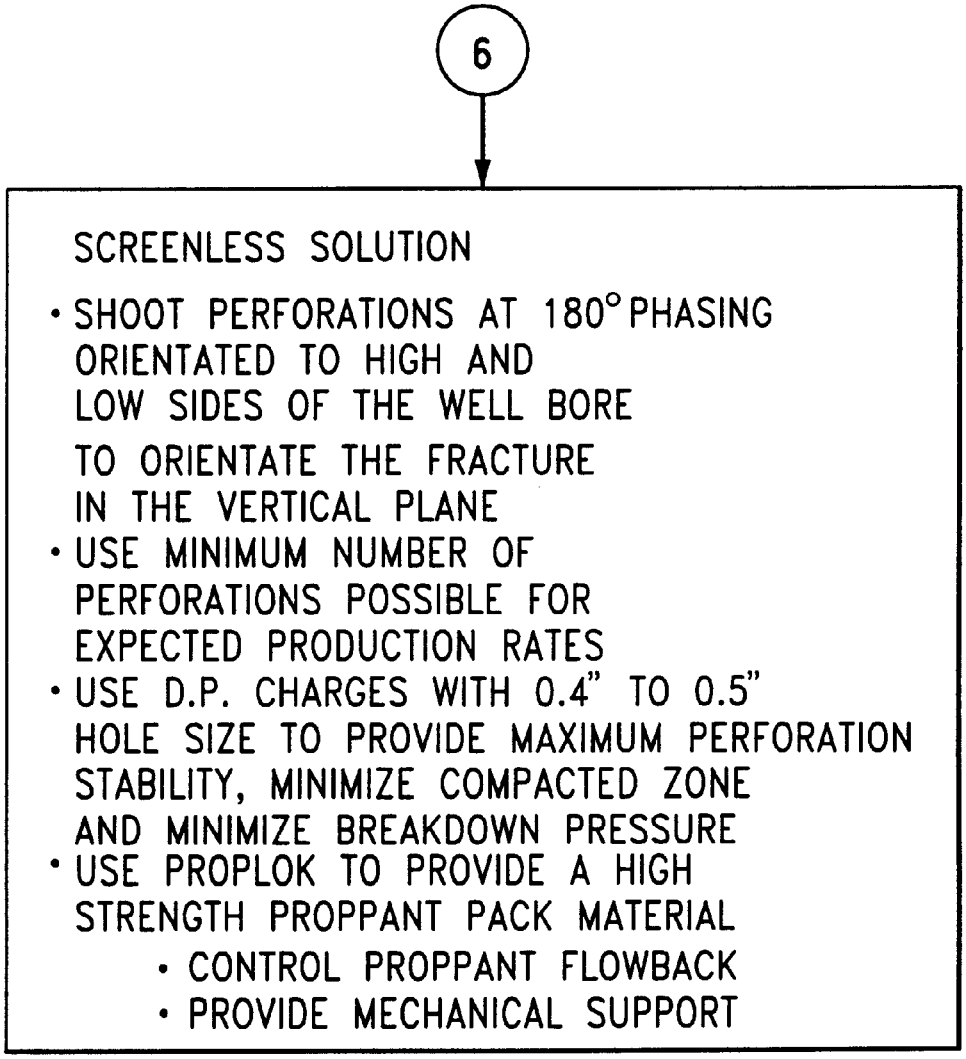
Figure 21:
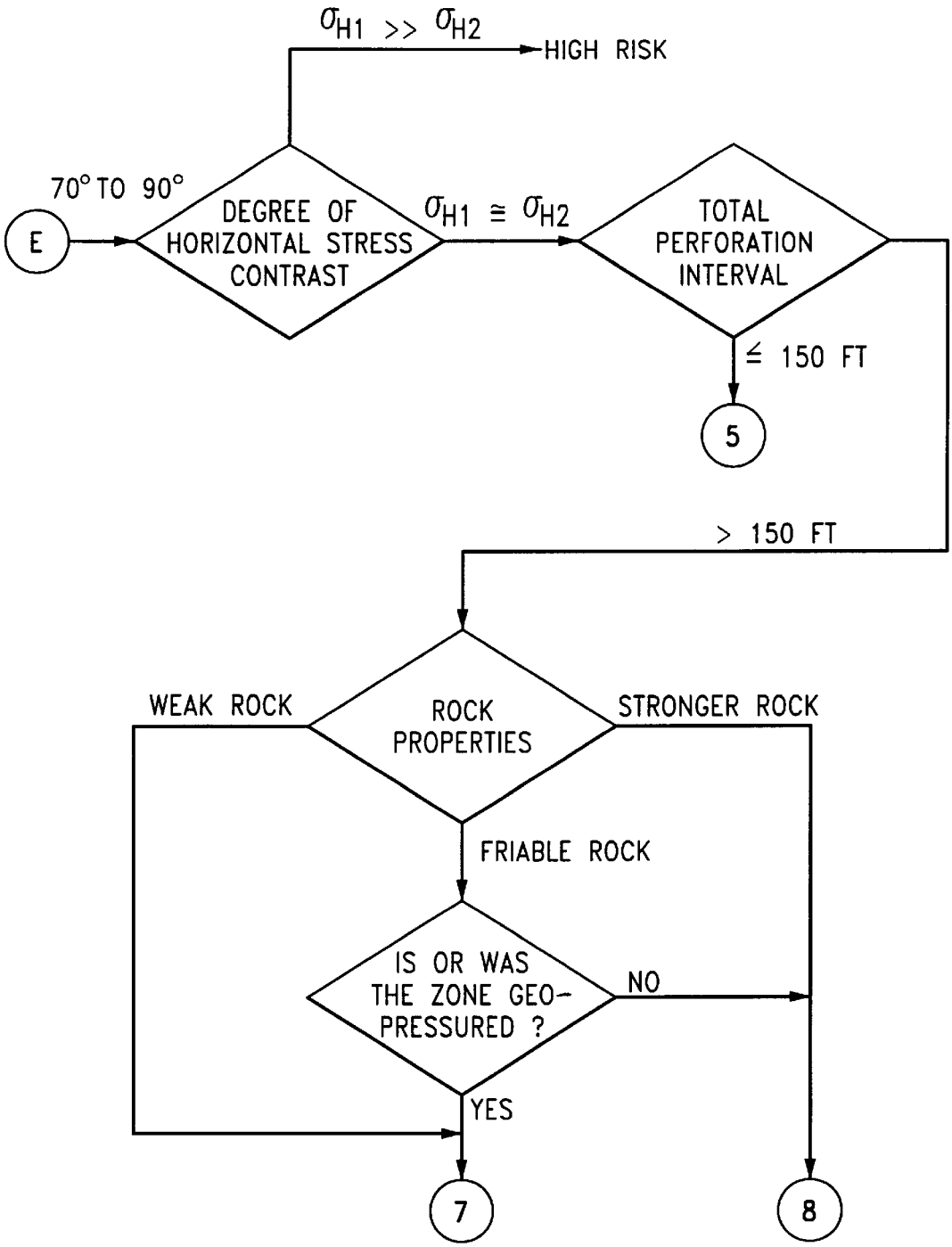
Figure 2M:
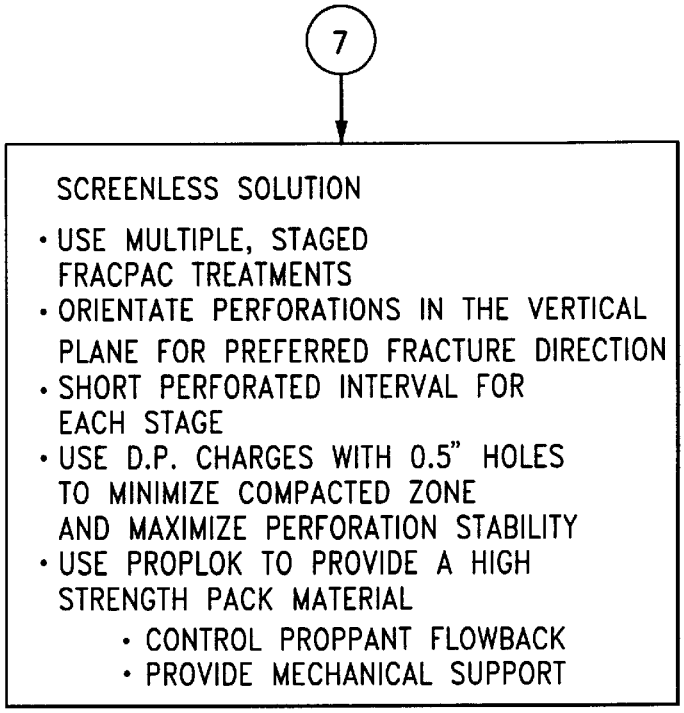
Figure 2N:
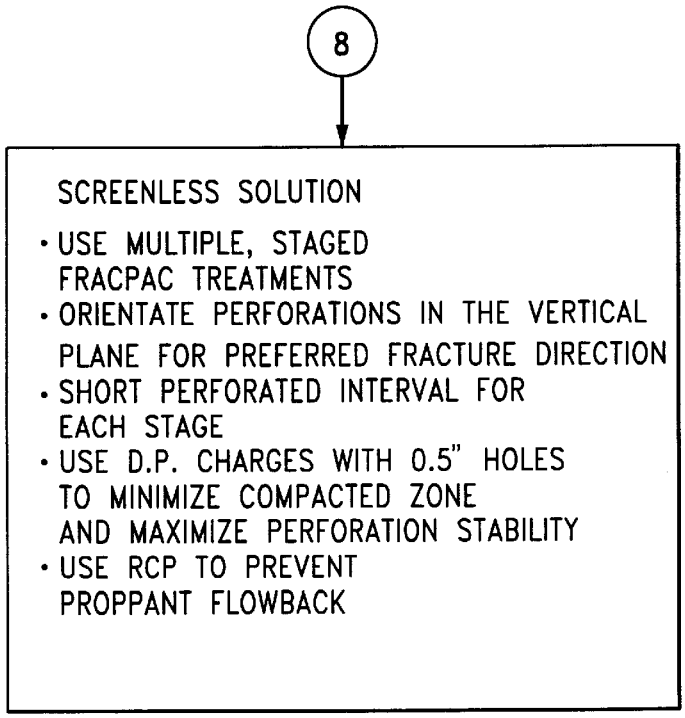

The flow diagram of FIGS. 2A–2N illustrates the possible sequences of the decision tree defined in the application program 8 of this implementation. Once a decision is executed for a condition (i.e., an entered item of characterizing data), the flow path proceeds to the next condition or branches off to one or more different flow paths. If all the decisions in a particular sequence followed for a particular well indicate candidacy for screenless completion, the sequence flow path ends with a recommendation of a particular screenless completion design. If not, the well is determined to be "high risk" and thus not a candidate for a screenless completion but rather for a conventional completion method, such as gravel pack, high rate water pack, acid prepack, or frac pack with screen. A particular program implementing the flow diagram of FIGS. 2A–2N can be written by one skilled in the art using any known suitable programming language. One particular implementation uses Visual Basic for a personal computer as mentioned above. The application program 8 helps to accelerate the decision making and to reduce the complexity involved in determining whether an oil or gas well is a candidate for a screenless completion and, if so, what a particular screenless completion design should be for that well.

Referring to FIG. 2A, prior to using the application program 8, determinations by the well owner and operating entities are made as to an estimated cost of the workover (can a screenless completion be afforded?), scheduling concerns (e.g., on an off-shore well, can rig and boat time be scheduled?), and loss of production (e.g., can risk of ruining the well by performing the stimulation be run?).

If the preceding step determines that the cost of workover, scheduling concerns, and loss of production are not excessive or are otherwise manageable or acceptable, the application program 8 determines, based on input data, whether it is a new completion or a recompletion. A new completion can be either a new well or a new zone in an existing well, and recompletion is with regard to a previously completed zone having existing perforations. In either event, the application program 8 next determines from the input data the range of the deviation at the perforated (or to be perforated) interval as shown by the two decision blocks in FIG. 2A.

FIGS. 2A–2E will next be described with reference to the branches of the decision tree extending from the "deviation at the perforation interval" decision when the selected well under analysis is for recompletion of an old zone with existing perforations. Then the remaining drawings will be described with reference to the possibilities from the determination of the "deviation at the perforation interval" for a new completion.

With regard to the determination of the deviation at the perforation interval for a recompletion, if the deviation is within the range between 30° and 70° (see FIG. 2A), this is considered to be a high risk well and thus one not suitable for screenless completion. This result is displayed via the display 10 and other completion options unrelated to the present invention may be pursued for that particular well.

FIG. 2B continues the process from point A in FIG. 2A for a 0° to 30° deviation (where common endpoints are used in defining ranges, there can be a variance to put a single point in one range or the other, or there can be one or more common points to define overlapping ranges and thus the possibility of two design options being available for such common values). A value for a deviation within this range at an existing perforation interval to be recompleted causes the process to progress to the branch of decisions including the length of the perforation interval, the fracture gradient at the interval, formation rock properties for the interval, whether the zone is or was geopressured, and temperature. If the length of the perforation interval is greater than 100 feet, an output is provided via the display 10 indicating that the well is not a candidate for screenless completion. If the length is less than 100 feet, the fracture gradient is considered. If the fracture gradient is greater than 0.85 pounds per square inch per foot, the well is not a candidate for screenless completion and an output is provided to indicate the same. A fracture gradient of less than 0.85 pounds per square inch per foot leads to a consideration of formation rock properties. Weak rock (unconfined consolidation strength (UCS) of 0 to 500 pounds per square inch (psi) and Young's Modulus of less than 500,000 psi) indicates the well is a candidate for screenless completion of the type specified in FIG. 2C (an on-the-fly liquid resin coating type). The same result is obtained for a well having friable rock (UCS of 500 to 1,500 psi and Young's Modulus of 500,000 to 1,000,000 psi) and the perforation zone is or was geopressured.

If the formation rock properties indicate friable rock which is not and was not geopressured, the well under consideration in FIG. 2B is still a candidate for screenless completion. If the temperature at the interval is less than 140° F. in this particular implementation, the screenless completion design of FIG. 2C is output. If this bottom-hole temperature is not less than 140° F., one of the type indicated in FIG. 2D is displayed (a resin-coated proppant (RCP) type). These same results are obtained for a well having stronger formation rock properties (UCS greater than 1,500 psi and Young's Modulus greater than 1,000,000 psi), but a UCS which is not greater than 2,000 psi as shown in FIG. 2B. If the UCS is greater than 2,000 psi, the displayed design is for a frac pack with pre-coated proppant (RCP) or with a surface modification agent that provides adhesiveness to the proppant surface to cause the proppant to stay in place in the formation (e.g., SANDWEDGE brand product from Halliburton Energy Services).

The screenless completion design of FIG. 2C indicates that a pre-frac consolidation should be used to stabilize the perforation and the near well bore region. A dissolvable particulate (e.g., hydroxyethylcellulose dissolvable particulate) should be used to divert resin into low permeability regions to obtain effective coverage of the entire interval (i.e., of both high and low permeability regions). The main frac pack for this screenless completion design is one of the type using a pumpable fluid comprising a liquid resin, particulate solids (e.g., proppant), and a viscous carrier fluid (e.g., fracturing fluid), such as particular ones referred to above. These materials mix on-the-fly as they are pumped downhole, thereby coating, the proppant with the resin. This provides high compressive strength proppant packed material and helps control fines at the formation face if the rock has already experienced mechanical failure, such as due to the formation material in this interval being weakened or unconsolidated and unable to withstand stresses resulting from draw down during production.

The screenless completion design of FIG. 2D also proposes use of a pre-frac consolidation and any means of diverting the resin to cover the entire interval; however, this design includes a main frac pack of the type using pre-coated particulate solids ("RCP" as referred to above) in a viscous fracturing fluid. Specific examples of RCP are made or marketed by Sandtrol and Acme Borden.

As mentioned, both of the designs of FIGS. 2C and 2D include pre-frac consolidation treatments. Thus, the present invention includes determining whether a respective well needs such a treatment (i.e., in the case of the process producing the designs of FIGS. 2C and 2D, such pre-frac consolidations are needed). These can be of any suitable type but typically include a pre-frac resin treatment of the near-well bore region prior to performing the recommended main screenless frac pack operation.

Referring next to FIG. 2E, this drawing illustrates comparisons that are made in the computer 6, running the application program 8, in response to a deviation between 70° and 90° at the perforation interval having existing perforations in the zone to be recompleted. Following the sequences illustrated in FIG. 2E, if the length of the perforation interval is greater than 100 feet, the well is not a candidate for a screenless completion. If the length is less than 100 feet, characterizing data pertaining to the degree of horizontal stress contrast ($\sigma$) is considered. If maximum horizontal stress ($\sigma_{H1}$) is much greater than (>>) minimum horizontal stress ($\sigma_{H2}$), the well is not a candidate for screenless completion (">>" indicates a maximum horizontal stress which is at least about thirty percent greater than the minimum horizontal stress). If $\sigma_{H1} \cong \sigma_{H2}$ (i.e., less than about a thirty percent difference in this implementation), then a determination is made about the fracture gradient data that has been input into the computer 6. If the fracture gradient is greater than 0.85 pounds per square inch per foot, the well is not a candidate for screenless completion. If the fracture gradient is less than 0.85 pounds per square inch per foot, then comparisons are made with regard to formation rock properties, whether the zone is or was geopressured, and temperature. If the formation is defined as weak rock, or as friable rock that is or was geopressured, or has bottom-hole temperature less than 140° F., the screenless completion design of FIG. 2C is indicated, otherwise, the screenless completion design of FIG. 2D is indicated (except for rock with UCS greater than 2,000 psi) as apparent from FIG. 2E. For rock with UCS greater than 2,000 psi, the displayed design is for a frac pack with pre-coated proppant (RCP) or with a surface modification agent that provides adhesiveness to the proppant surface to cause the proppant to stay in place in the formation (e.g., SANDWEDGE brand product from Halliburton Energy Services).

If the selected well is for a new completion (whether in a new well or a new zone in an existing well), comparisons of input characterizing data 4 to predefined parameters or ranges of parameters are made in accordance with the flow diagrams of FIGS. 2F–2N.

FIG. 2F shows the decisions made under control of the application program 8 in the computer 6 for a deviation angle of between 0° and 30° at the new interval to be perforated. If the degree of horizontal stress contrast is $\sigma_{H1 \approx \sigma H2}$ (which here and in other similarly identified comparisons includes $\sigma_{H1}>\sigma_{H2}$ but less than $\sigma_{H1}>>\sigma_{H2}$) and the length of the perforation interval is less than 30 feet, then formation rock properties and geopressuring of the zone and temperature are considered in the same manner as described above, and shown in FIG. 2F. For weak rock or friable rock which is or was geopressured, or the indicated conditions with temperature less than 140° F., the screenless completion design of FIG. 2G is displayed. Otherwise, the screenless completion design of FIG. 2H is output, unless the UCS is greater than 2,000 psi. In the latter case, the displayed design is for a frac pack with pre-coated proppant (RCP) or with a surface modification agent that provides adhesiveness to the proppant surface to cause the proppant to stay in place in the formation (e.g., SANDWEDGE brand product from Halliburton Energy Services).

Continuing in FIG. 2F, if the degree of horizontal stress contrast is greatly different ($\sigma_{H1}>>\sigma_{H2}$) and perforations cannot be oriented to the preferred fracture direction, the selected well is not a candidate for screenless completion. If the perforations can be oriented to the preferred fracture direction and the length of the perforation interval is less than 30 feet, the aforementioned comparisons regarding formation rock properties and geopressure are made as indicated in FIG. 2F. If the perforation interval length is greater than 30 feet, but less than 150 feet, the well is a candidate for screenless completion having a design as indicated in FIG. 2I. If the perforation length is greater than 150 feet, such well is not a candidate for screenless completion.

The screenless completion design of FIG. 2G includes having perforations shot at 180° phasing oriented to the preferred fracture direction, using a minimum number of perforations possible for the desired production rates, and using deep penetration charges with 0.4-inch to 0.5-inch hole sizes to provide maximum perforation stability, minimize compacted zone, and minimize breakdown pressure. The fluid of this design uses a liquid resin, particulate solid and viscous carrier fluid system of the on-the-fly type described above.

The screenless completion design of FIG. 2H is the same as for FIG. 2G except the fluid system is of the type having the pre-coated particulate solid (RCP) in the viscous carrier fluid.

The screenless completion design of FIG. 2I is similar to the design of FIG. 2G except that in FIG. 2I, the design also includes using a mechanical diversion tool (e.g., coiled tubing with opposing swab cups) to provide complete coverage and total perforation treatment.

FIGS. 2J and 2K will next be described with regard to a new completion in a zone having a deviation of between 30° and 70°. In this type of well, a significant difference in degree of horizontal stress indicates a well not suitable for screenless completion. If the horizontal stress contrast is less than the significant difference level, and the length of the interval is greater than 20 feet, this type of well is likewise not suitable for screenless completion. If the length is less than 20 feet in a well which does not have a substantial horizontal stress contrast for a 30° to 70° interval deviation, such well is a screenless completion candidate utilizing the design of FIG. 2K. Referring to FIG. 2K, this design includes shooting perforations at 180° phasing oriented to the high and low side of the well bore to orient the fracture in the vertical plane, using a minimum number of perforations possible for expected production rates, and using deep penetration as charges with 0.4-inch to 0.5-inch hole sizes to provide maximum perforation stability, minimize compacted zone, and minimize breakdown pressure. This design is one of the on-the-fly systems using the liquid resin, particulate solids, and viscous carrier fluid mixture.

For a completion in a new zone having a deviation of between 70° and 90°, the comparisons and decisions of FIG. 2L are made. If the degree of horizontal stress contrast is significantly different, such well is not a candidate for screenless completion. If the horizontal stress contrast is not significantly great and the total perforation interval is 150 feet or less, the well is a candidate for screenless completion of the type shown in FIG. 2I described above. If the total perforation interval is greater than 150 feet, formation rock properties and whether the zone is or was geopressured and the temperature are considered using the same parameters as described above. For weak rock or friable rock which is or was geopressured or with temperature less than 140° F. as shown in FIG. 2L, a screenless completion design of FIG. 2M is selected. For stronger rock or friable rock which is not and was not geopressured, and temperature not less than 140° F., the screenless completion design of FIG. 2N is selected.

The screenless completion design of FIG. 2M includes the use of multiple staged frac pack treatments, oriented perforations in the vertical plane for preferred fracture direction, short perforated intervals for each stage, utilization of deep penetration charges with 0.5-inch holes to minimize compacted zone and maximize perforation stability, and an on-the-fly fluid system including liquid resin, particulate solids and viscous carrier fluid. The design of FIG. 2N is the same except for the use of the fluid system, which in FIG. 2N is of the type having pre-coated resin (RCP) and viscous carrier fluid.

The particular implementation of FIG. 2 provides nine predetermined screenless completion designs, each one of which is associated with one or more predetermined sequences. Which sequence is followed for a particular selected well, and thus which automated decision is made for that well, depends on the set of characterizing data 4 for that well input into the computer 6 for processing in accordance with application program 8. Using the output from the computer 6 and display 10, the indicated screenless completion is performed on the well in known manner.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A process of designing a screenless completion for an oil or gas well, comprising:

selecting an oil or gas well having a plurality of known characteristics;

inputting data about the known characteristics into a programmed computer;

determining, through operation of the programmed computer, whether a screenless completion should be performed on the selected well and, if so, identifying materials to be used in the screenless completion;

in response to identifying materials to be used, indicating to a user a screenless completion design using the identified materials;

performing the selecting, inputting, determining, identifying and indicating steps for other oil or gas wells, wherein identifying materials includes identifying the same materials for the respective screenless completion for each well having the same value set of known characteristics for which data are input into the computer; and wherein identifying materials includes distinguishing, through operation of the computer, between wells for which a liquid resin, proppant and fracturing fluid are to be used and wells for which a proppant, pre-coated with resin, and fracturing fluid are to be used.

2. A process as defined in claim 1, wherein identifying materials further includes determining whether a respective well needs a pre-frac consolidation treatment.

3. A process as defined in claim 1, wherein distinguishing between wells includes comparing against respective predetermined data stored in the computer input data representing formation rock properties of the selected well and whether the treatment zone of the well is or was geopressured and a temperature in the well.

4. A process as defined in claim 1, wherein distinguishing between wells includes comparing against respective predetermined data stored in the computer input data representing bottom-hole temperature, angular deviation of an interval of the respective well to receive a screenless completion, a length of the interval, a degree of horizontal stress contrast at the interval, fracture gradient at the interval, an ability to orient perforations at the interval, formation rock properties for the interval, and whether the interval is or was geopressured.

5. A process as defined in claim 1, wherein identifying materials further includes identifying, for wells for which a liquid resin, proppant and fracturing fluid are to be used, a liquid resin which does not substantially adversely affect the fracturing fluid and yet which coats the proppant in the fracturing fluid and enables a high compressive strength proppant pack to be obtained when placed in the well.

6. A process of designing a screenless completion for an oil or gas well, comprising:

selecting an oil or gas well having a plurality of known characteristics;

inputting data about the known characteristics into a computer;

determining, through operation of the computer, one of three options for the selected well including (1) determining that the selected well is not a candidate for screenless completion, (2) determining that the selected well is a candidate for screenless completion using a mixture of a carrier fluid, a hardenable resin composition, and particulate solids, and (3) determining that the selected well is a candidate for screenless completion using a mixture of a carrier fluid and particulate solids pre-coated with a hardenable resin composition before mixing with the carrier fluid, in response to (2) or (3) above, indicating to a user one of a plurality of screenless completion designs using the respective one of the carrier fluid, hardenable resin composition and particulate solids or the carrier fluid and pre-coated particulate solids;

performing the selecting, inputting, determining, and indicating steps for other oil or gas wells, wherein determining one of three options includes determining the same option for each well having the same value set of known characteristics for which data are input into the computer; and wherein making determinations (2) and (3) includes determining whether a near-well bore consolidation treatment is needed in addition, and prior, to the respective mixture.

7. A process as defined in claim 6, wherein determining one of three options includes comparing against respective predetermined data stored in the computer input data representing formation rock properties of the selected well and whether the treatment zone of the well is or was geopressured.

8. A process as defined in claim 6, wherein determining one of three options includes comparing against respective predetermined data stored in the computer input data representing a bottom-hole temperature, an angular deviation of an interval of the selected well, a length of the interval, a degree of horizontal stress contrast at the interval, a fracture gradient at the interval, an ability to orient perforations at the interval, formation rock properties for the interval, and whether the interval is or was geopressured.

9. A process of designing a screenless completion for an oil or gas well, comprising:

selecting an oil or gas well having a plurality of selected known characteristics including whether there is to be new completion in the selected well or recompletion of an old zone having existing perforations, a deviation at a perforation interval, a length of the perforation interval, a fracture gradient, a degree of horizontal stress contrast, formation rock properties, whether the perforation zone is or was geopressured, a temperature in the well;

inputting data about the known characteristic into a computer;

determining, through automatic operation of the computer responsive to the input data, whether a screenless completion should be performed on the selected well and, if so, identifying materials to be used in the screenless completion;

indicating to a user, through automatic operation of the computer, one of at least nine predetermined screenless completion designs, wherein the indicated one includes the identified materials and is selected by the computer in response to the input data;

performing the selecting, inputting, determining, identifying and indicating steps for other oil or gas wells, wherein identifying materials includes identifying the same materials for the respective screenless completion for each well having the same value set of selected known characteristics for which data are input into the computer; and wherein one of the materials includes a mixture of a carrier fluid, a hardenable resin composition, and particulate solids and another of the materials includes a mixture of a carrier fluid and particulate solids pre-coated with a hardenable resin composition before mixing with the carrier fluid.

10. A process of designing a screenless completion for an oil or gas well, comprising:

inputting into a computer data characterizing a perforation interval for an oil or gas well;

comparing in a selected predetermined sequence in the computer input data with predetermined data correlated by characteristic of the perforation interval, including selecting the predetermined sequence in response to each compared characteristic;

associating in the computer one of a plurality of predetermined screenless completion design files, stored in the computer, with the selected predetermined sequence;

displaying the associated predetermined screenless completion design file to a user such that the displayed file is used for performing the predetermined screenless completion on the oil or gas well;

performing the inputting, comparing, associating and displaying steps for additional oil or gas wells, including associating the same predetermined screenless completion design files with the same respective selected predetermined sequences each time those respective selected predetermined sequences are selected; and wherein the input data correlates to perforation interval characteristics including a deviation at the perforation interval, a length of the perforation interval, a fracture gradient, a degree of horizontal stress contrast, formation rock properties, whether the perforation zone is or was geopressured, and a bottom-hole temperature.

11. A process as defined in claim 10, wherein at least some of the predetermined screenless completion design files specify a first pumpable fluid including a mixture of a carrier fluid, a hardenable resin composition, and particulate solids, and at least others of the predetermined screenless completion design files specify a second pumpable fluid including a mixture of a carrier fluid and particulate solids pre-coated with a hardenable resin composition before mixing with the carrier fluid.

12. A process as defined in claim 10, wherein the input data correlates to perforation interval characteristics including a deviation at the perforation interval, a length of the perforation interval, a fracture gradient, a degree of horizontal stress contrast, formation rock properties, whether the perforation zone is or was geopressured, and a bottom-hole temperature.

13. A process as defined in claim 12, wherein at least some of the predetermined screenless completion design files specify a first pumpable fluid including a mixture of a carrier fluid, a hardenable resin composition, and particulate solids, and at least others of the predetermined screenless completion design files specify a second pumpable fluid including a mixture of a carrier fluid and particulate solids pre-coated with a hardenable resin composition before mixing with the carrier fluid.

14. A process as defined in claim 10, wherein at least some of the predetermined screenless completion design files specify a first pumpable fluid including a mixture of a carrier fluid, a hardenable resin composition, and particulate solids, and at least others of the predetermined screenless completion design files specify a second pumpable fluid including a mixture of a carrier fluid and particulate solids pre-coated with a hardenable resin composition before mixing with the carrier fluid.

* * * * *